US005201676A

United States Patent [19]

Duffield et al.

[11] Patent Number: 5,201,676

[45] Date of Patent: Apr. 13, 1993

[54] MOLDED CABLE ASSEMBLY

[75] Inventors: Douglas D. Duffield, New Paris; William J. Weber, Eaton, both of Ohio

[73] Assignee: Cooper Industries, Inc., Houston, Tex.

[21] Appl. No.: 826,123

[22] Filed: Jan. 27, 1992

[51] Int. Cl.[5] ..... H01R 9/03

[52] U.S. Cl. ..... 439/610; 439/607

[58] Field of Search ..... 439/607–610, 439/350, 736, 174

[56] References Cited

U.S. PATENT DOCUMENTS

| | | | |
|---|---|---|---|
| 4,662,700 | 5/1987 | Markham | 439/607 |
| 4,699,438 | 10/1987 | Kikuta | 439/607 |
| 4,721,483 | 1/1988 | Dickie | 439/610 |
| 4,723,916 | 2/1988 | Fusselman et al. | 439/607 |
| 4,781,623 | 11/1988 | Philippson et al. | 439/610 |
| 4,822,304 | 4/1989 | Herron | 439/610 |
| 5,028,492 | 7/1991 | Guenin | 439/931 |

*Primary Examiner*—Larry I. Schwartz
*Assistant Examiner*—Hien D. Vu
*Attorney, Agent, or Firm*—Laff, Whitesel, Conte & Saret

[57] ABSTRACT

A cable assembly for connecting a connector shell to a mating connector, the assembly having an electrical connector and a cable which are interconnected to form the assembly comprising: a cable shield for covering the cable along its entire length; a first molded housing for covering the connector to cable interface and for providing a substrate for the cable shield; a second molded housing for covering the first molded housing and for locking the cable assembly to the mating connector; and a third molded housing for securing the cable and the connector to cable interface to the second molded housing.

14 Claims, 2 Drawing Sheets

MOLDED CABLE ASSEMBLY

FIELD OF THE INVENTION

This invention relates to a cable assembly. More particularly, this invention relates to a cable assembly having a molded housing around the connector to cable interface.

BACKGROUND OF THE INVENTION

A variety of electrical cable assemblies are known. Typically, these known assemblies for computers and like equipment include metal or molded housings which protect or insulate cable wires at the connector to cable interface and further protect other cable components, including connectors with or without connector shields. In the known metal housings, the connector to cable interface is unrestrained within the housing. In contrast, in the known molded housings, the connector to cable interface is integral with the molding itself.

While these known assemblies provide a generally adequate means to protect or insulate cables, and in particular the connector to cable interface, there are problems associated with their use. For example, the current metal housings that are used in cable assemblies are not designed to accept a wide range of cable diameters. Thus, the number of cables that are actually usable in metal housings is very limited. Therefore, it becomes necessary to have an assortment of differently sized housing for accommodating various cable sizes. These sizes restrictions escalate the cost of cable assemblies.

In addition to the aforementioned size restrictions of metal housings, the presently used molded housing require large interface openings for plugging or connecting multi pin male connector cable assemblies into mating female connectors. This requirement is especially burdensome in situations wherein there is limited space.

Despite the numerous disadvantages with the abovementioned cable assemblies, these assemblies are still widely used in electrical connector and cable industries. Thus, while these cable assemblies protect or insulate cables and cable connectors, they do not effectively resolve any of the aforementioned problems.

Accordingly, an object of the present invention is to provide a cable assembly with a molded housing around the connector to cable interface.

Yet another object of the present invention is to provide a cable assembly with a molded housing around the connector to cable interface which accepts a wide range of cable diameters.

A further object of the present invention is to provide a cable assembly with a molded housing around the connector to cable interface which reduces the opening size of the connecting interface required for plugging the assembly into a mating connector.

SUMMARY OF THE INVENTION

The present invention, in a preferred embodiment, accomplishes the foregoing objects by providing a cable assembly for connecting a connector shell to a mating connector that includes, in part, an electrical connector and a cable that are interconnected to form an interface which is covered by a first molded housing or premold. The use of a premold not only protects the connector to cable interface but also provides a substrate for continuous shielding of a metallized mylar cable shield which extends along the length and exterior of the cable. A second molded housing or shroud covers the shielded premold and includes two spring latches that are located on opposite sides of the shroud for reducing its interface to that of the shielded premold and for locking the cable assembly to the mating connector. A third molded housing or post mold includes an opening for receiving the cable and is used to secure both the cable and the connector to cable interface to the shroud. The post mold may be changed to accommodate any diameter size of cable.

Each of the above molded housings is pre-molded. The first molded housing is generally made from a single piece of material. The second and third molded housings include two separate but identical pieces which, when molded together, form a single molding unit.

Thus, the invention provides a cable assembly that includes a premold for covering the connector to cable interface and for providing a substrate for continuation shielding of the cable shield to the connector. The assembly also includes a shroud which covers the shielded premold, holds spring latches that reduce the size of the interface area to that of the premold, and locks the cable assembly to the mating connector. The assembly further includes a post mold which secures the cable to the shroud. Any diameter of cable may be accommodated by tooling changes in the post mold.

The above, as well as other objects and advantages of the invention, will become apparent from the following detailed description of the preferred embodiments, reference being made to the accompanying drawings.

DETAILED DESCRIPTION OF THE INVENTION

Figure 1:
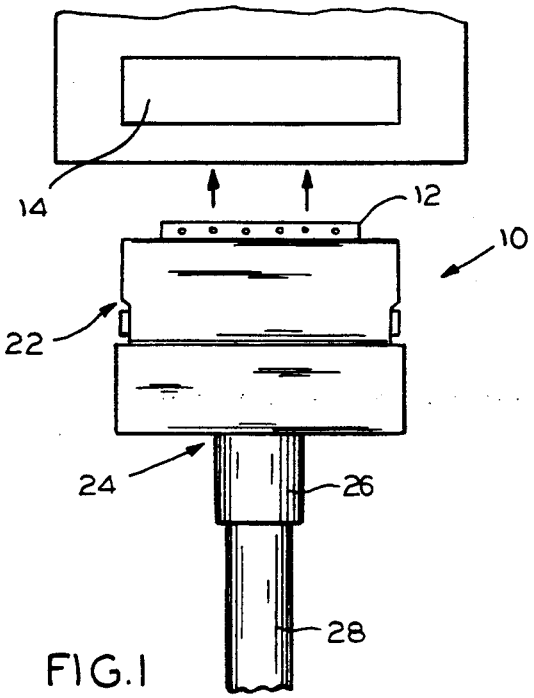
FIG. 1 is a side view of the inventive cable assembly, illustrating its attachment to a mating connector.
Figure 2:
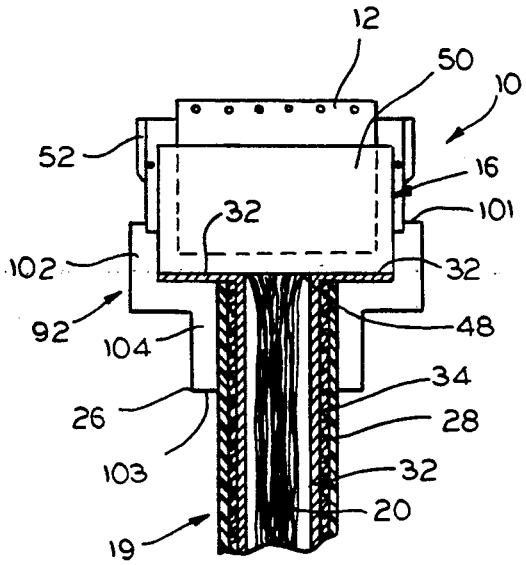
FIG. 2 is a cross-sectional view of the assembly of FIG. 1.
Figure 3:
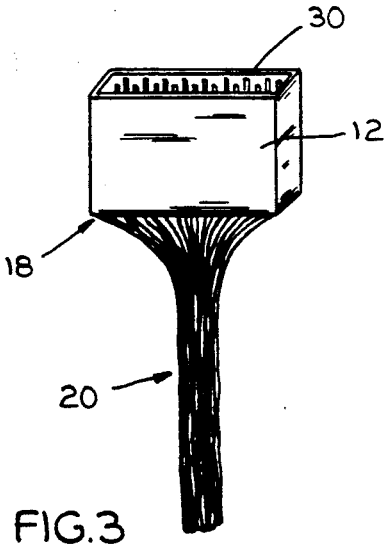
FIG. 3 is a perspective view of the connector shell and cable wires of FIG. 2.

Generally referring to FIG. 1-3, the invention provides a cable assembly, generally denoted by the numeral 10, for connecting a connector shell 12 to a mating connector 14 having, in part, a first molded housing or premold 16 which covers an connector cable interface 18 formed by a plurality of cable wires 20 and the connector shell 12; a second molded housing or shroud 22 which covers the premold 16 and locks the cable assembly to mating connector 14; and a third molded housing or post mold 24 which includes an opening 26 or receiving a cable jacket 28 and further which secures cable 28 to shroud 22.

Figure 4:
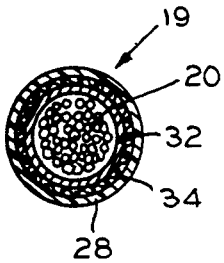
FIG. 4 is a cross-sectional view of the cable.

Referring first to FIGS. 1-3, in a preferred embodiment, connector shell 12, which has been shown as a multi pin male connector for purposes of illustration only, is generally rectangular in shape and includes a plurality of vertically extending pins 30 that are interconnected at one end with a plurality of cable conductor wires 20 at connector-cable interface 18 (see FIG. 3). Wires 20 are covered along their entire length by a metallized mylar or polyester film or cable shield 32 (see FIG. 4) which will be discussed in greater detail hereinafter. A protective metallic braid 34 is positioned over and extends along the length of he mylar film 32 (also see FIG. 4). Likewise, the entire cable assembly 19 is protected by cable jacket 28.

Figure 5:
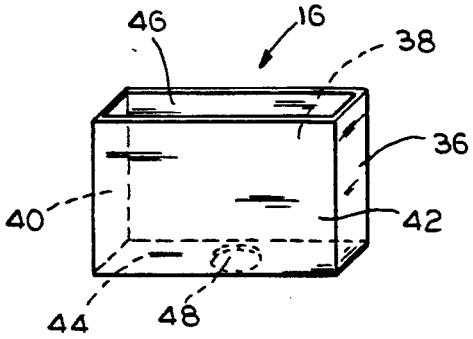
FIG. 5 is a perspective view of the premold of FIG. 2.
Figure 6:
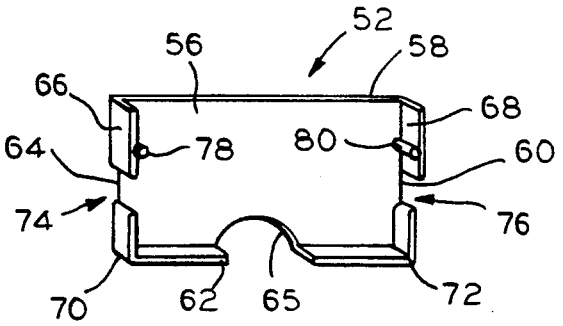
FIG. 6 is a perspective view of one-half of the shroud of FIG. 2.
Figure 7:
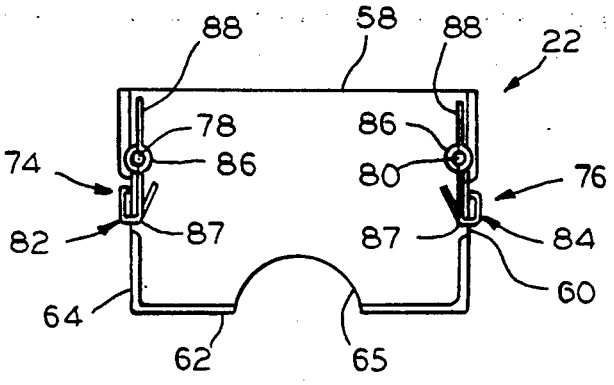
FIG. 7 is a perspective view of the shroud of FIG. 6.

As shown in FIGS. 2 and 5, first molded housing or premold 16 is also generally rectangular in shape and is made of a metallic material. In the preferred embodiment, premold 16 is molded from a single piece of metal and folded into its rectangular shape. In an alternate embodiment, premold 16 is formed by folding two pieces of metal together. In either embodiment, premold 16 includes four sides 36, 38, 40, 42, a bottom 44, and an open top 46. An opening 48 is centrally located in bottom 44 which allows cable wires 20 to pass through the premold when connector shell 12 is positioned inside of premold 16, as is illustrated in FIG. 2 and explained in greater detail below.

As shown in FIG. 2, connector shell 12 is housed within premold 16. Attached cable wires 20 of connector shell 12 extend through opening 48 of premold 16 and, as previously discussed, are covered by mylar film 32. Similarly, the bottom portion of premold 16 adjacent to opening 48 is also covered by mylar film 32 which extends from cable wires 20 to premold 16. This continuous mylar film covering on premold 16 and cable wires 20 provides complete shield integrity from the cable to the connector shell. A copper tape wrapping 50 covers the external surface of sides 36, 38, 40 and 42 of premold 16.

Second molded housing or shroud 22 covers shielded premold 16 and includes two identical pre-molded halves 52 and 54 (see FIGS. 2, 6-8). Each half is generally rectangular in shape and includes a back portion 56 with edges 58, 60, 62 and 64. Sides 66 and 68 extend upwardly from and partially enclose edges 60 and 64. Likewise, L-shaped sides 70 and 72 extend upwardly from back portion 56 at adjacent corners formed by the union of edges 60, 62 and 62, 64. A semi-circular opening 65 is located on edge 62 between sides 70 and 72. Between sides 66 and 70 and sides 68 and 72 are openings 74 and 76, respectively. Adjacent openings 74 and 76 are posts 78 and 80 which pivotally support spring latches 82, 84 (see FIG. 7). Spring latches 82, 84 each include a circular opening 86 at one end through which posts 78 and 80 extend. At an opposite end, a bulbous portion 87 of spring latches 82, 84 extends through openings 74 and 76 of shroud 22. A straight section 88 of spring latches 82 and 84 extends towards edge 58 adjacent opening 86 and is laterally displaced when pressure is applied to bulbous portion 87. Thus, section 88 is used, in conjunction with bulbous portion 87, to reduce the opening size of the interface area 90 (see FIG. 8) of shroud 22 to that of premold 16.

Third molded housing or post mold 24 secures cable assembly 19 to shroud 22 (see FIGS. 1, 2, 8, 9) and includes two identical premolded halves 92, 94 that are generally T-shaped. FIG. 9 shows T-shaped half 92 which includes vertically extending sides 96, 98 and 100. Half 94 is identical to half 92 and also includes vertically extending sides. There is no vertically extending side, however, on edges 101 or 103 of post mold 24.

The upper portion 102 of halves 92 and 94 are generally rectangular in shape whereas, the lower portions 104 are semi-circular in shape. Lower portions 104, when assembled together, form a circular opening 105 (see FIG. 8) for retaining cable assembly 19. Thus, upper portion 102 may accommodate the shape of rectangular shroud 22 while lower portion 104 is shaped to secure cable assembly 19. FIG. 2 shows edge 62 of shroud 16 intersecting edge 101 of post mold 24. Likewise, cable assembly 19 is retained by lower portion 104 of post mold 24. Post mold 24 may be sized to accommodate different sizes of cable diameter.

Figure 8:
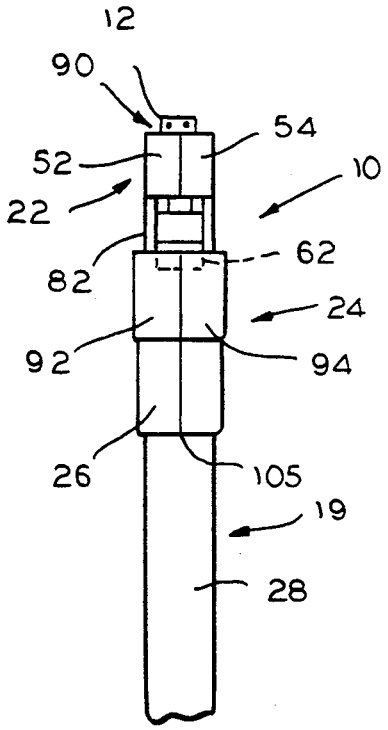
FIG. 8 is a side view of the assembly of FIG. 1.
Figure 9:
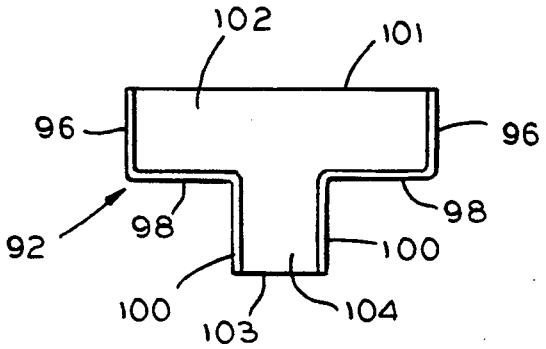
FIG. 9 is a side view of the post mold of FIG. 2.

Finally, FIG. 8 shows shroud 22 and post mold 24 as assembled. Identical halves 52 and 54 of shroud 22 are molded together with edge 62 being overlapped by edge 101 and secured within the joined halves 92 and 94 of post mold 24. Likewise, cable assembly 19 is securely retained within opening 105 of post mold 24.

The material from which cable assembly 10 is constructed includes any conventional non-corrosive metal for pre-mold 16 and spring latches 82, 84 and any plastic material, such as polyphanylane oxide by General Electric Noryl, for shroud 22 and post mold 24. Moreover, cable assembly 10 has not been described in terms of approximate measurements, as it should be understood that the size of the post mold may vary according to the size of the cable.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the true scope and spirit of the invention.

The invention claimed is:

1. A cable assembly for connecting a connector shell to a mating connector comprising:

a cable having a plurality of wires attached to a connector shell to form an interface between said wires and said connector shell;

a first molded housing covering at least a portion of said connector shell and all of said connector shell to wire interface and providing a substrate for a cable shield;

said able shield covering said cable along its entire length and a portion of said first molded housing;

a second molded housing covering said first molded housing and locking the cable assembly to the mating connector; and a third molded housing surrounding and attaching to a portion of said cable and a portion of said second molded housing to secure said cable and said connector shell to said second molded housing.

2. The cable assembly of claim 1 wherein said cable shield additionally covers said first molded housing for continuation shielding of said cable shield to said connector.

3. The cable assembly of claim 1 wherein said second molded housing includes at least one spring latch for reducing an interface area adjacent to and above said spring latch of said second molded housing to that of said first molded housing and for locking the cable assembly to the mating connector.

4. The cable assembly of claim 3 wherein said spring latch is located on at least one side of said second molding housing.

5. The cable assembly of claim 1 wherein said third molded housing includes an opening for receiving said cable.

6. The cable assembly of claim 1 wherein said first molded housing is a one piece pre-molded unit.

7. The cable assembly of claim 6 wherein said first molded housing is metal.

8. The cable assembly of claim 7 wherein said first molded housing is copper wrapped.

9. The cable assembly of claim 1 wherein said second molded housing is a two piece pre-molded unit.

10. The cable assembly of claim 9 wherein said second molded housing is plastic.

11. The cable assembly of claim 1 wherein said third molded housing is a two piece pre-molded unit.

12. The cable assembly of claim 11 wherein said third molded housing is plastic.

13. The cable assembly of claim 1 wherein said cable shield is a metallized mylar film.

14. A cable assembly for connecting a connector shell to a mating connector comprising:

a cable having a plurality of wires attached to a connector shell to form an interface between said wires and said connector shell;

a first one piece pre-molded housing covering at least a portion of said connector shell and all of said connector shell to wire interface and providing a substrate for a cable shield, said first pre-molded housing also being covered by said able shield for continuation shielding of said cable shield to said connector shell;

said cable shield being metallized mylar and covering said cable along its entire length and a portion of said first pre-molded housing;

a second two-piece pre-molded housing covering said shielded first pre-molded housing said second pre-molded housing including two spring latches that are located on opposite sides of said second pre-molded housing reducing its interface to that of said shielded first pre-molded housing and locking the cable assembly to the mating connector; and a third two-piece pre-molded housing having an opening for receiving aid cable, said third pre-molded housing also surrounding and attaching to a portion of said cable and a portion of said second molded housing to secure said cable and said connector shell to said second pre-molded housing.

* * * * *